United States Patent [19]

Garchinsky

[11] 4,429,355

[45] Jan. 31, 1984

[54] LUMINAIRE RAISING AND LOWERING SYSTEM

[75] Inventor: John S. Garchinsky, Aldan, Pa.

[73] Assignee: Union Metal Manufacturing Company, Canton, Ohio

[21] Appl. No.: 195,020

[22] Filed: Oct. 8, 1980

Related U.S. Application Data

[60] Division of Ser. No. 943,726, Sep. 18, 1978, Pat. No. 4,228,488, which is a continuation of Ser. No. 723,099, Sep. 14, 1976, abandoned.

[51] Int. Cl.[3] ..... F21V 21/36

[52] U.S. Cl. ..... 362/403; 362/250; 362/401; 362/402; 362/418; 362/431

[58] Field of Search ..... 362/403, 250, 401, 402, 362/418, 431

[56] References Cited

U.S. PATENT DOCUMENTS

| | | | |
|---|---|---|---|
| 3,696,241 | 10/1972 | Meyer et al. | 362/403 |
| 3,801,813 | 4/1974 | Kiehn | 362/403 |
| 3,840,212 | 10/1974 | Latanision | 362/403 |
| 4,115,845 | 9/1978 | Blahut | 362/403 |
| 4,195,332 | 3/1980 | Thompson | 362/403 |
| 4,198,022 | 4/1980 | Pletcher et al. | 362/403 |
| 4,228,488 | 10/1980 | Garchinsky | 362/403 |
| 4,234,165 | 11/1980 | Murray et al. | 362/403 |
| 4,237,530 | 12/1980 | Murray et al. | 362/403 |

*Primary Examiner*—Stephen J. Lechert, Jr.
*Attorney, Agent, or Firm*—Frease & Bishop

[57] ABSTRACT

The luminaire raising and lowering system includes a mast head in which a plurality of sets of pulleys are located. A carrier ring containing a number of lighting fixtures is suspended from the top head mast by a plurality of cables associated with respective ones of said sets of pulleys. Those cables are connected to a main winch cable through intermediate linkage means which compensate for differences in the length of said plurality of cables and enable the carrier effectively to "float". Means are also provided to monitor the tension on the main winch cable thereby preventing accidents due to undue slackness of the main winch cable or mispositioning of the same on the winch reel. Four cable and three cable systems are disclosed. Novel latching means are provided to take the load off of the suspension cables when the carrier is at the top of the pole in normal use.

14 Claims, 14 Drawing Figures

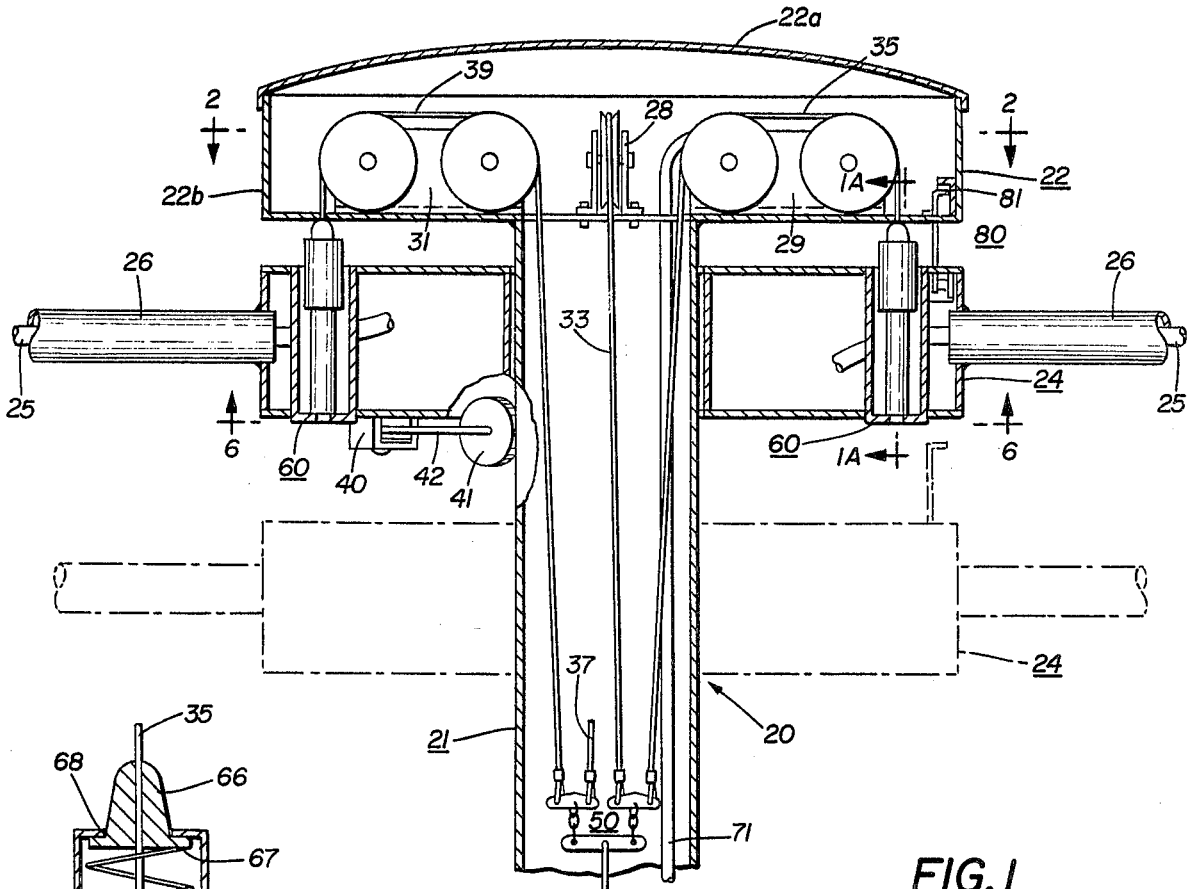
FIG. 1
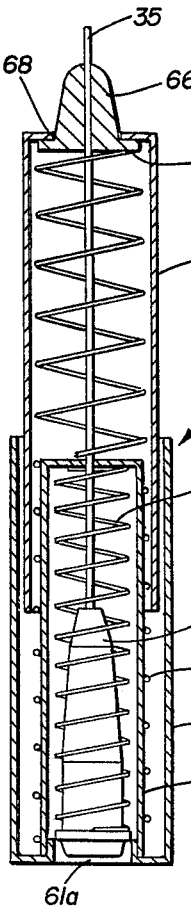
FIG. 1A
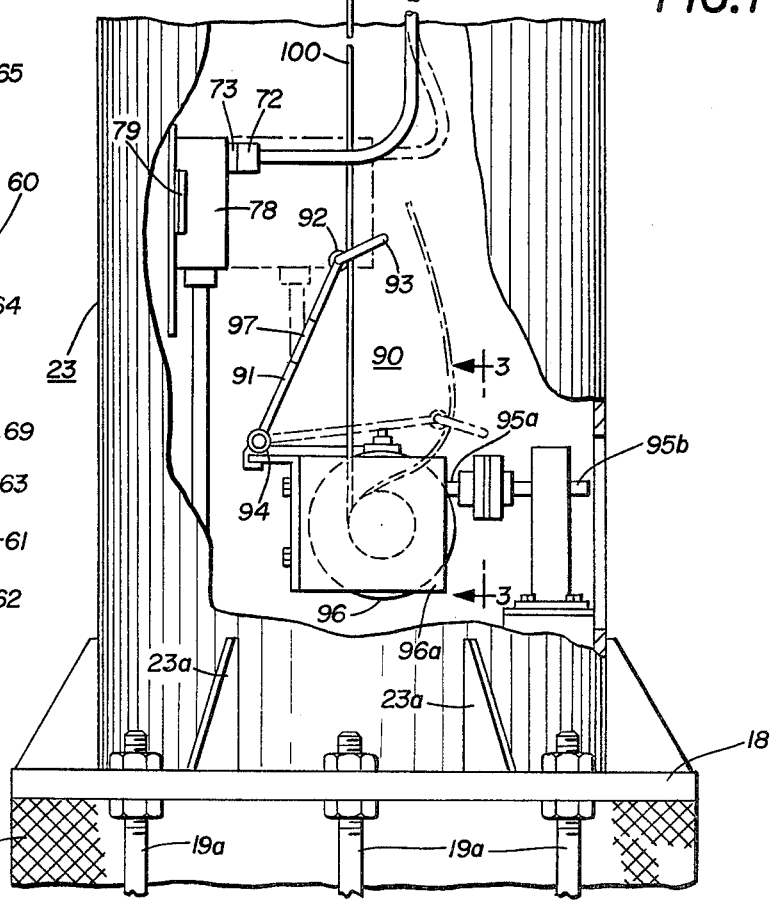

FIG. 2
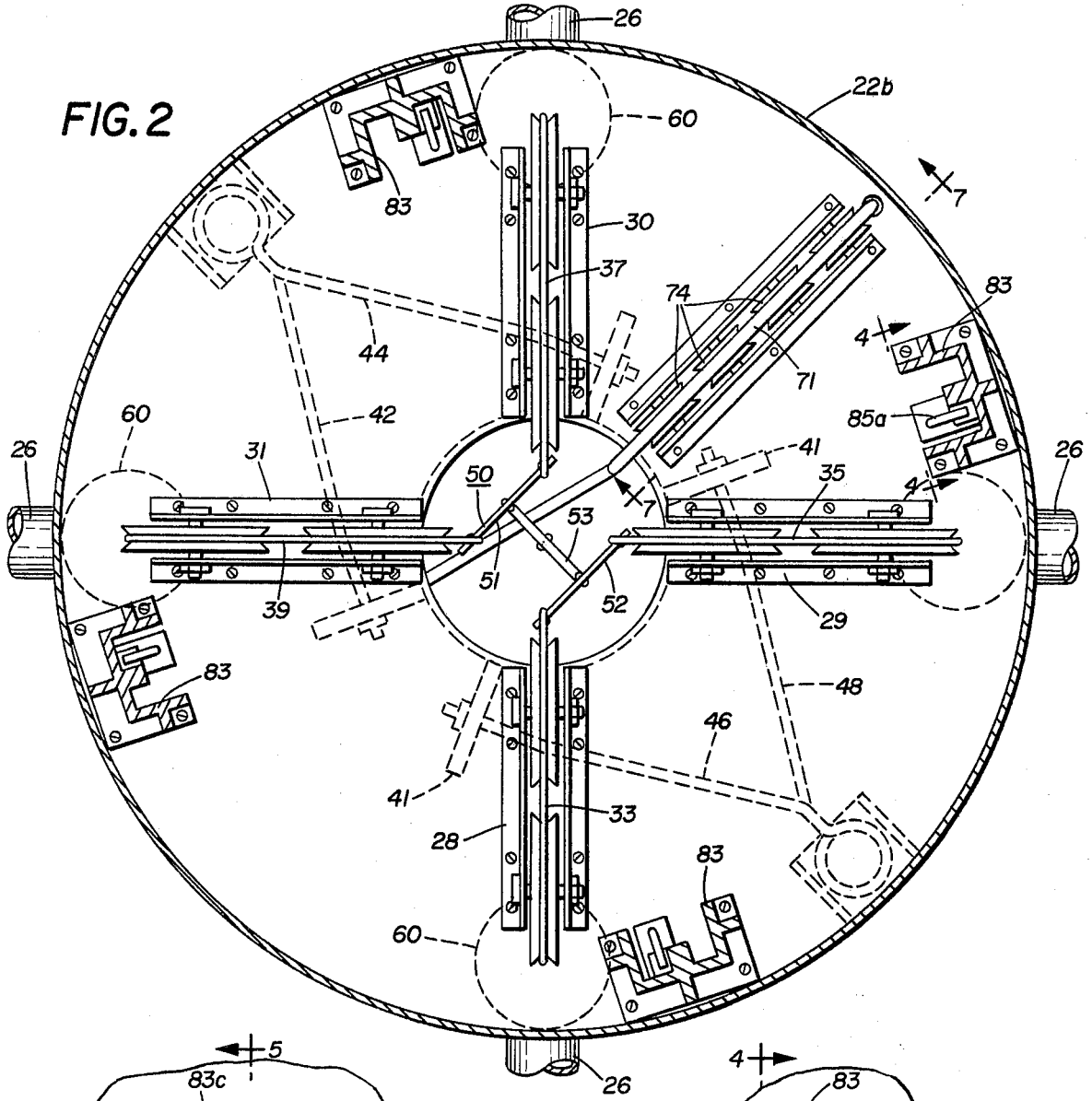
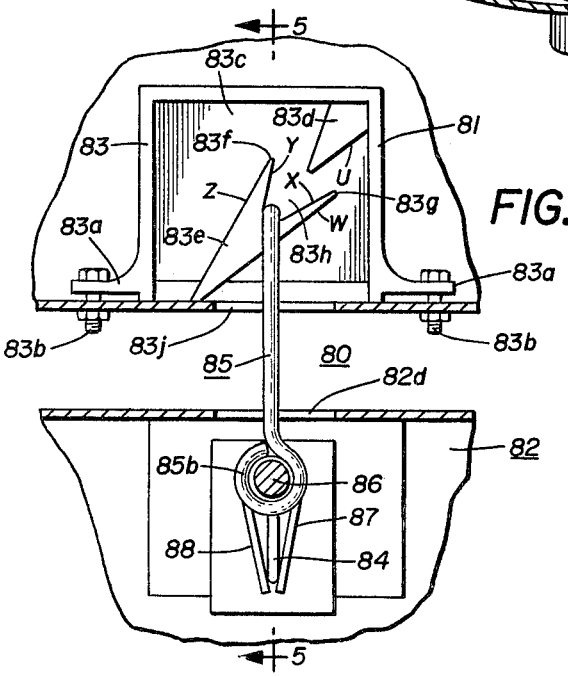
FIG. 4
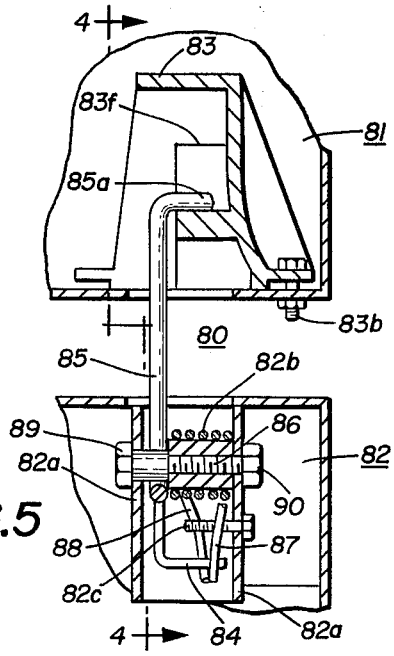
FIG. 5

FIG. 3
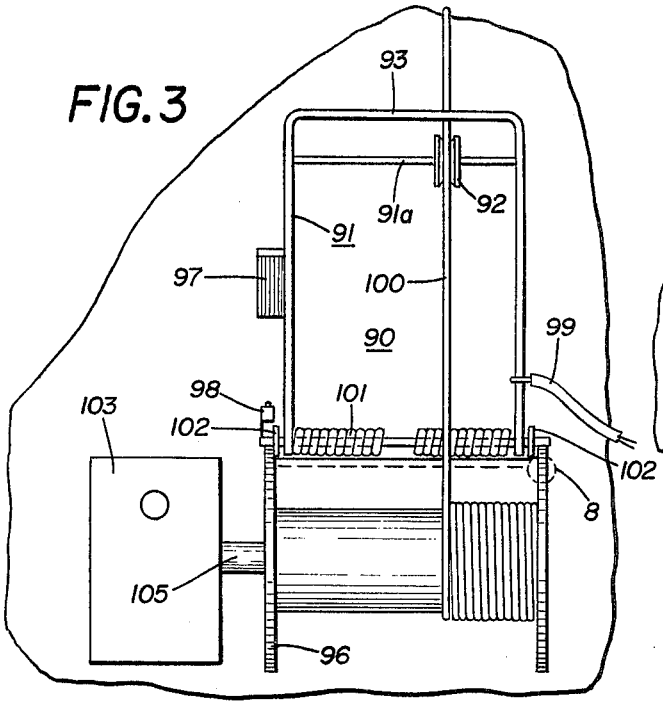
FIG. 7
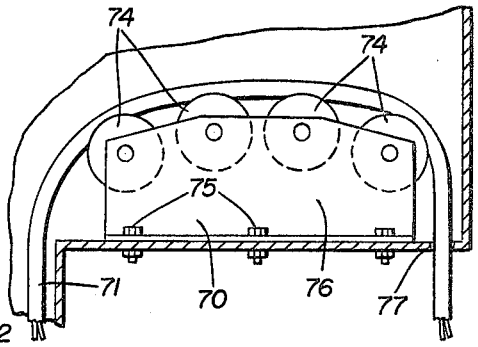
FIG. 8
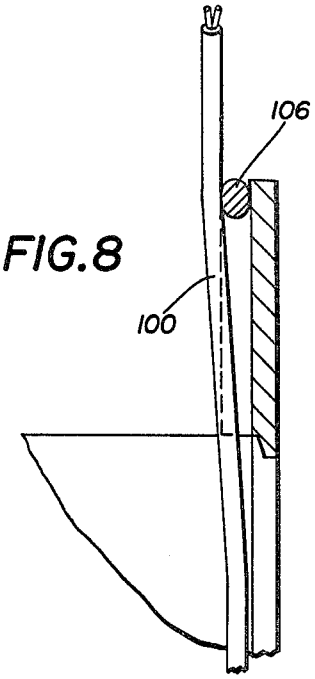
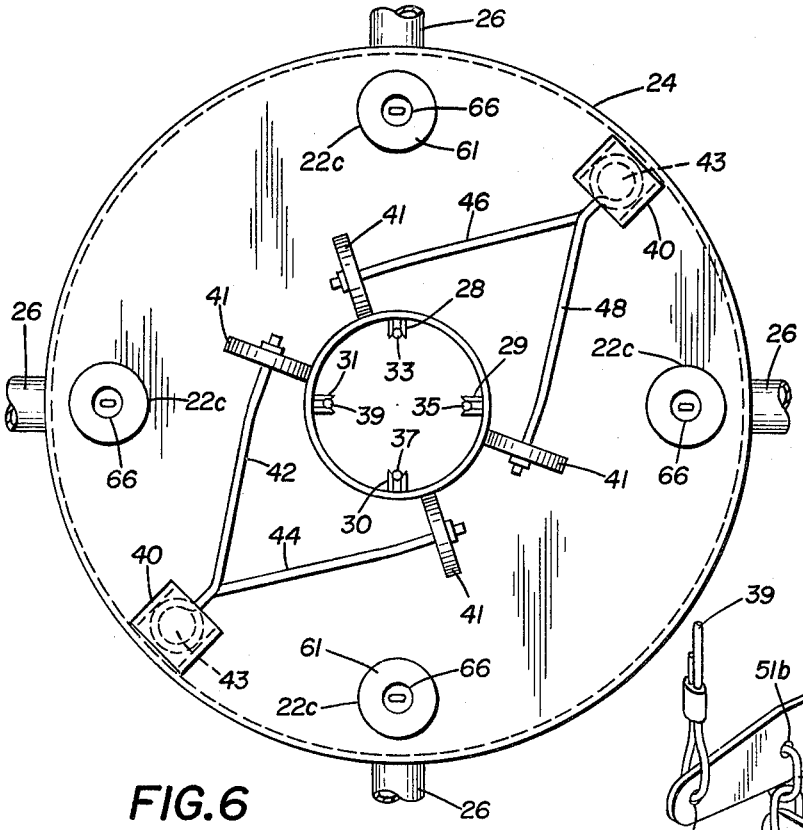
FIG. 6
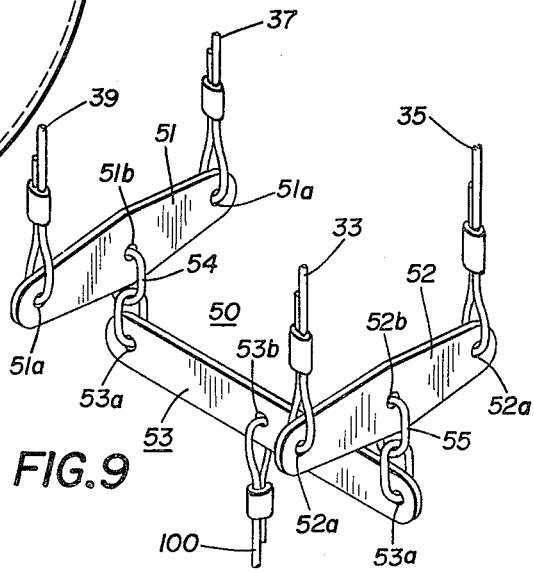
FIG. 9

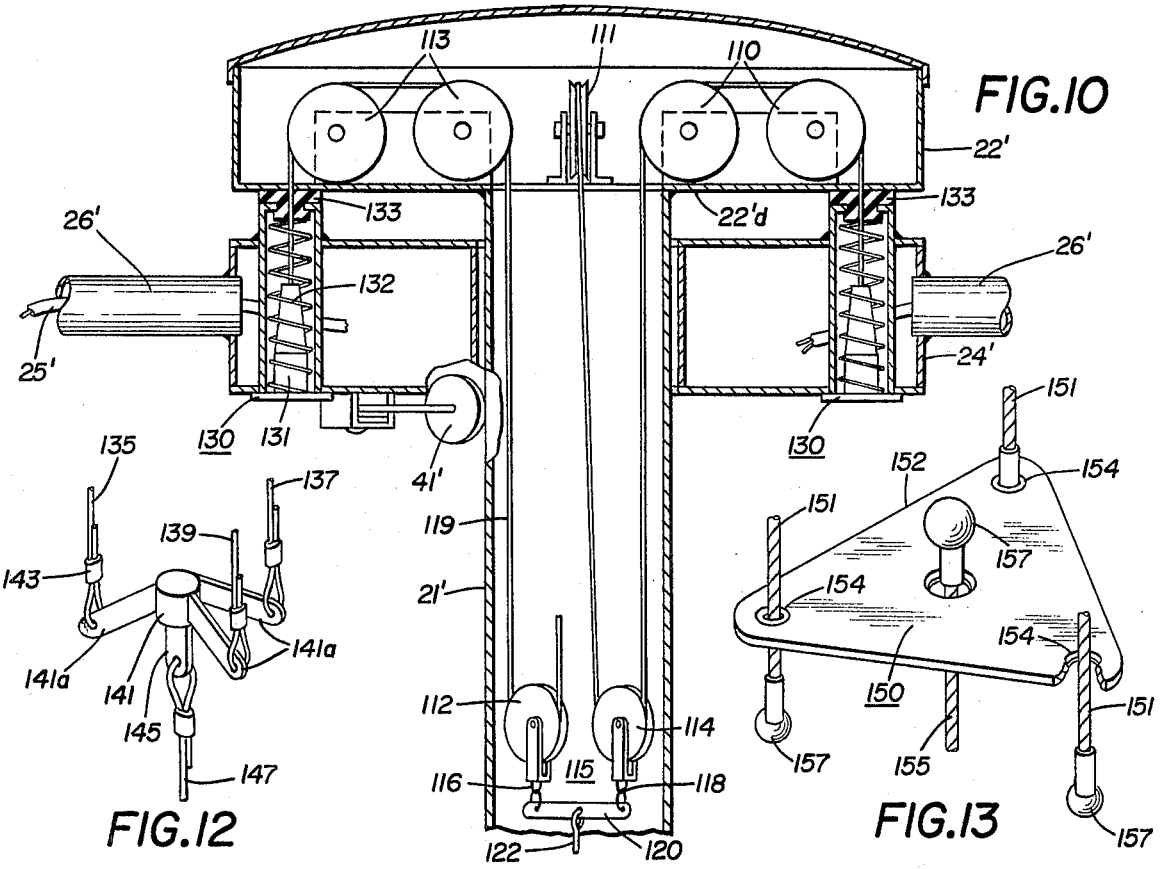
FIG.10
FIG.12
FIG.13
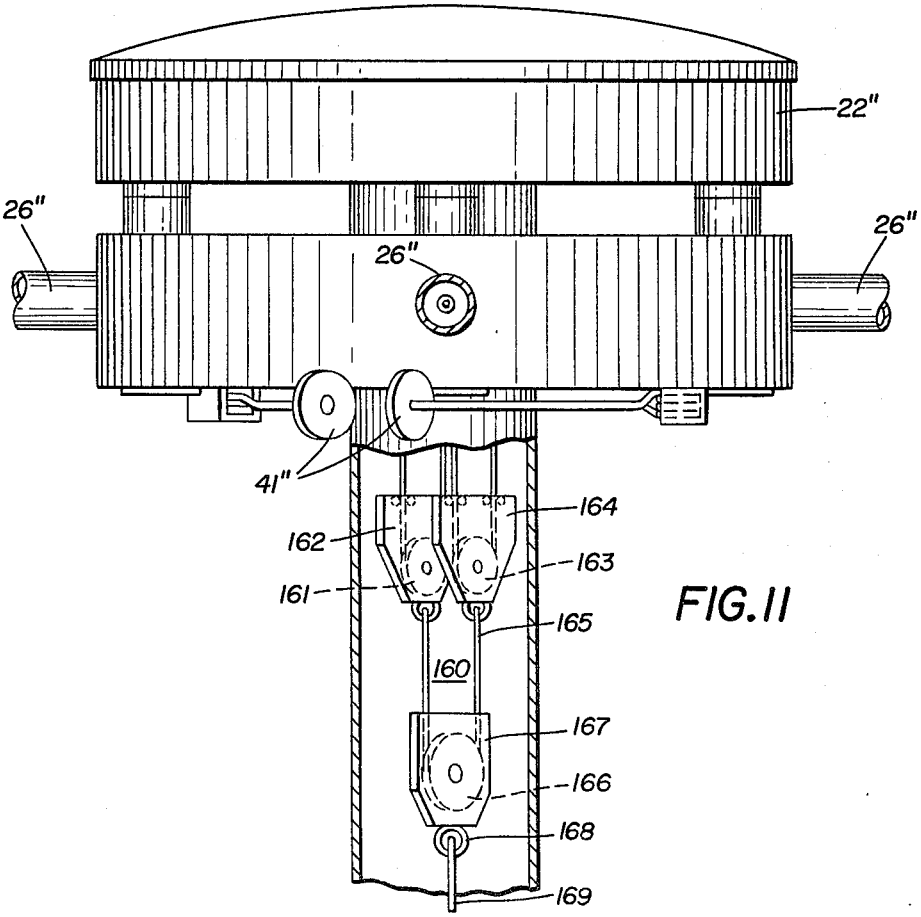
FIG.11

LUMINAIRE RAISING AND LOWERING SYSTEM

This application is a division of application Ser. No. 943,726 filed 9/18/78 now U.S. Pat. No. 4,228,488 which is a continuation of application Ser. No. 723,099 filed Sept. 14, 1976, now abandoned.

BACKGROUND OF THE INVENTION

In recent years, poles for holding street lights outdoors have been made taller and taller. Since they are further from the ground, they employ more powerful lights and appropriate lenses for dispersing the light so that the lighted area is far greater than with lower poles. The rationale for using fewer, very tall poles rather than a larger number of shorter poles adjacent the highway, especially at highway intersections, is that fewer poles reduce the accident hazard to motorists.

The newer poles have attained heights of about 150 feet. With such height, their bulbs or lamps are out of the range of conventional "cherry pickers" and therefore servicing of the lights including bulb replacement is more difficult than with shorter poles. Nor is it practical to have built-in or removable ladders to enable maintenance personnel to ascend the pole to service the luminaries.

To meet the more difficult problems of bulb replacement and general maintenance, a number of schemes have been evolved. At first, the individual lights were suspended by steel cables which passed the hollow pole and over pulleys at the top so that each light could be lowered to the ground when desired simply by unwinding a sufficient length of cable. The problem with this arrangement was that lights that simply hung from individual steel cables tended to be blown around or to sway voilently in the wind causing cable wear and damage to the lights by the continuous movement. Also, over an extended period of time, the steel cables tended to stretch causing the lights to be lower than their normal height.

A later approach was to mount several of the lights on a movable carrier which was lowered to the ground by internal steel cables within the pole to permit access to the lights and then was raised by the same cable to normal height. To relieve some of the constant strain that would be imposed on the cables if they were used as the sole support of the carrier in elevated position, the carrier included a number of latch mechanisms which engaged corresponding mechanisms on the mast head at the top of the pole. Even with the use of the light carrier, the construction of the newer poles with such luminaire raising and lowering systems continued to present safety problems. First of all, the carrier itself could weigh 1500–1800 pounds so that, in the event of a mishap during raising or lowering it, if it fell, it could endanger the life of the maintenance worker or others below.

Second, even where a number of steel cables have been used to lower the carrier, the cables often become stretched and different cables may have different stretching characteristics. This stretching could even be aggravated by unevenness in the raising of the carrier which, in turn, itself contributes to additional stretching.

Third, the internal cable running up to the carrier can sometimes run off the sides of the winch reel causing "down time" of the luminaire because the cable can be damaged and has to be replaced. In some instances, it might even be dangerous to unwind severely damaged cable so that the entire pole might have to be taken down by a crane in order to change the cable or correct the problem.

It is therefore among the objects of the present invention to provide:

1. Tall luminaire poles with safer, more stable lowering carriers.
2. Tall luminaire poles with built-in systems for detecting unsafe conditions, especially conditions resulting from stretched, slack or stuck lowering cables.
3. Tall luminaire poles with improved means for latching the light carrier to the top of the pole.
4. Tall luminaire poles with means for compensating for unequal stretch or length of the cables attached to the carrier.
5. Tall luminaire poles with means for compensating for unevenness in the raising (or lowering) of the carrier.

SUMMARY OF THE INVENTION

A system for raising and lowering luminaires or the like comprising support means toward the top of a pole, a carrier including a plurality of luminaires suspended from said support means by a plurality of elongated means having respective first ends thereof connected to the carrier, linkage means coupled to the other ends of said plurality of elongated means, said linkage means having various parts thereof capable of assuming different vertical positions relative to other parts thereof, and a single elongated means couple to said linkage means and adapted to be connected to means for imparting tension to said single elongated means. Means are provided for monitoring the tension of said single elongated means so that said single elongated means can neither be raised nor lowered in the event of detection by said monitoring means of a predetermined condition of slackness in said single means.

BRIEF DESCRIPTION OF THE DRAWINGS

FIG. 1 is a side elevation, partly sectional and partly broken-away view of one form of the present invention;

FIG. 1A is an enlarged cross-sectional view of the bumper-shock absorber assembly shown in FIG. 1 taken along the section line 1A—1A.

FIG. 2 is a sectional view of part of the apparatus shown in FIG. 1 taken along the section line 2—2 of FIG. 1 in the direction indicated;

FIG. 3 is an enlarged fragmentary view of the lowering cable monitoring system taken in the direction of the arrows associated with line 3—3 of FIG. 1;

FIG. 4 is a partly sectional, fragmentary enlarged view of a part of the apparatus shown in FIG. 2 taken along the line 4—4 in the direction indicated;

FIG. 5 is a sectional view of the apparatus shown in FIG. 4 taken along the section line 5—5 in the direction of the arrows;

FIG. 6 is a view taken from the bottom of the light-carrier assembly along the line 6—6 of FIG. 1;

FIG. 7 is an enlarged fragmentary view of the pulley subassembly associated with the electrical cable taken along the line 7—7 in the direction indicated in FIG. 2;

FIG. 8 is an enlarged view of the circled portion of FIG. 3;

FIG. 9 is an enlarged perspective view of the subassembly shown in FIG. 1;

FIG. 10 is a fragmentary side elevation view, partly sectional and partly broken-away, of another form of the invention;

FIG. 11 is a fragmentary side elevation view, partly in section, of still another form of the invention;

FIG. 12 is an enlarged, perspective view of a subassembly by which three lowering cables are connected to the winch cable in accordance with an alternate form of the present invention; and FIG. 13 illustrates yet another subassembly by which three lowering cables are connected to the winch cable in accordance with another form of the invention.

DETAILED DESCRIPTION OF THE DRAWINGS

Referring now to FIGS. 1, 1A, 2, 6 and 7, the novel tall pole luminaire raising and lowering system is shown generally at the numeral 20. It comprises a mast head 22 situated atop the pole from which is suspended, over pairs of pulleys located within the mast head 22, the luminaire carrier 24 having a generally toroidal central portion and a plurality of tenons 26 extending outwardly therefrom, each tenon supporting one or more lamps or lights. The central aperture of the carrier assembly 24 is fitted around the generally circular cross-section of the pole 21 which is narrower at the top and flares somewhat toward its bottom portion 23. The base portion 23 is affixed by nuts or other appropriate fastening mechansims to upright bolts 19*a* embedded in concrete 19, the bolts penetrating corresponding apertures in a slab or mounting plate 18.

The mast head 22 has a generally dome-shaped top 22*a*, made of, for example, a spun metal such as aluminum that covers a generally cylindrical space in which four pairs of cable pulleys are located. The pairs are respectively mounted on axles journalled in pairs of L-shaped brackets 28, 29, 30 and 31, respectively. Lowering and raising cables 33, 35, 37 and 39 are respectively passed over the pairs of cables so that at their outer ends thereof near the perimeter of the head 22, they are respectively connected to four bumper-shock absorber subassemblies indicated generally at numeral 60. Their respective other ends are attached to subassembly 50 which is also connected to the winch cable 100 that is wound about a reel 96.

By providing the subassembly 50, each of the raising and lowering cables or ropes 33, 35, 37 and 39 is free to have some independent vertical movement and the pair of cables 39, 37 can have different vertical positions relative to the pair 33, 35 without affecting the vertical position of the top of winch rope 100 since the only effect of such difference would be to tilt the axis of cross bar 53 away from true horizontal. This feature therefore helps to compensate for differences in the amounts that the cables 33, 35, 37 and 39 become stretched through usage. It imparts a sort of "floatability" to the suspension or lowering system.

From FIGS. 1 and 2, it will be noted that the cord or cable 35 has its outer end attached to one of the bumper-shock absorber subassemblies 60 and, after passing over the pair of pulleys associated with bracket 29, descends into the interior of pole portion 21. As shown in FIG. 9, its other end passes through an aperture 52*a* at one end of linkage member 52 and then is bent back upon itself and fixed into position by an appropriate sealing clasp. At the other end of that member 52, there is another aperture 52*a* through which one end of the wire rope or cord 33 is connected in similar fashion. Similarly, wire ropes 37 and 39 pass through and are fixed in apertures 51*a* located at opposite ends of a second member 51 which is the counterpart of the member 52.

Connected between the vertical planar members 51 and 52, but generally at right angles thereto, is a cross bar 53. Sets of links 54 and 55 coupled to apertures 53*a* in opposite ends of the cross bar 53, also respectively pass through central apertures 51*b* and 52*b* in the vertical members 51 and 52 respectively. The upper end of a winch cord or rope 100 passes through central aperture 53*b* in the cross bar 53, is turned back upon itself and is fixed with an appropriate metallic or other clasp or band in a conventional manner.

It will be seen that the members 51 and 52 are free to swivel about an axis passing through central apertures 51*b* and 52*b* respectively depending whether the end of the line attached to member 51 or 52 at one end is higher or lower than the end of the line attached to the other end thereof and vice versa. It is also evident that the member 51 at any point could be higher than the member 52 if lower ends of the lines 37 and 39 have been pulled up higher than the lower ends of the lines 35 and 33, or are not stretched as much as the latter. The opposite case is also possible. Or, if the middles of members 51 and 52 are generally at the same height, perhaps the left end of member 51 could be lower than the right end thereof whereas the opposite could be true of member 52.

Regardless of the positions of members 51, 52 or cross bar 53, the action of subassembly 50 is to permit the force exerted upon the lines 33, 35, 37 and 39 to be generally equalized. Thus, for example, if the carrier 24 tilts downward from left to right as viewed by the reader hereof, or if the length of the ropes or lines 33, 35, 37 and 39 are unequal, the "floating" functioning of the linkage subassembly 50 helps to prevent undue stress on particular ones of the down-coming ropes thereby helping to prevent stretching or undue loading of some of the ropes.

Also located within the mast head 22 is an electrical cable 71 that supplies the current via subsidiary wires 25 passing through the tenons 26 to the lamps supported at the ends of the tenons. The cable 74 is passed over the four pulleys 74 disposed on axles between brackets 70 mounted by bolts 75 on the floor 77 of the head 22. The other end of the cable is attached to plug 72 that is plugged into socket 73 on a panel 78 that is attached by hinge 79 to a vertical support within the portion 23 of the pole.

The luminaire carrier or ring 24, when raised to the top of the pole, is latched at four points by latch subassemblies indicated generally at the numeral 80. Subassemblies 80 comprise a lower portion 82 mounted in carrier 24 toward its periphery, an arm 85 connected thereto and an upper portion 81 mounted in mast head 22 toward its perihery, the portion 81 being engaged by the upper end of the arm 85 in a manner to be explained in detail below.

In order to stabilize the ascent and descent of the ring carrier 24 up and down the pole, there are provided, as an optional feature, sets of stabilizing rollers 41, each being mounted toward the angled ends of the elongated axles 42. The angled ends are to permit the full widths of the rollers to bear against the outer surface of the pole. The other ends of axles 42 are disposed around vertical pins or bolts 43 within brackets 43 that are mounted to the floor 77 on the under side of the carrier 24. In addition to helping to keep the ring carrier 24 generally perpendicular during raising and lowering, they also assist the carrier ring 24 to resist being twisting due to wind or other causes.

Monitoring Subassembly 90

FIGS. 1 and 3 show a unique and novel system for monitoring the position of the winch cable 100. As stated above, it sometimes happens that because of defective latching or other reasons, the winch cable 100 may become slack. If the defective latch suddenly is released, or if the other cause for the slackness is suddenly corrected, the 1500–1800 pound ring carrier 24 could plummet to the ground thereby injuring the maintenance man below. The maintenance man may be, at the time, near the base 23 or even have his hands partly or fully inside base portion 23 operating, for example, the electric drill which powers, through appropriate coupling, the winch.

The novel monitoring system comprises the use of a metallic, inverted U-shaped member 91 with an upper angled bight portion 93 having at its lower extremities two aligned apertures through which pivot pin 94 passes, the pin also passing through two other coaxial apertures formed in vertical dielectric members 102 outside of the member 91. The member 91 is positioned so that the winch cable 100 passes between the horizontal traverse rod 91*a* and the bight 93 of member 91. The winch drum or spool 96 is driven by any appropriate power source such as the shaft 95*a* that is coupled to a torque limiter 95. The shaft 95*b* schematically represents a power takeoff shaft with appropriate means for coupling its right end to a heavy duty power drill (not shown), for example, that is operated by the maintenance man.

Slideably arranged on the traverse rod 91*a* is a pulley 92 made of a dielectric material. A spring 101 positioned around the pivot pin 94 biases the member 91 in the clockwise direction (as seen in FIG. 1) so that the winch cable 100 is kept in contact with the pulley 92. A switch actuating plate 97 of dielectric material is fastened to the left leg of the member 91 (FIG. 3) so that if the cable 100 becomes slack (as shown in phantom lines in FIG. 1) the plate 97 will be urged clockwise and will depress pushbutton or microswitch 98 which is disposed toward the end of its pivoting path. The switch 98 is so wired with respect to the source of power for the electric drill that when this slack condition occurs, power to the drill and hence to winch 96 is cut off. When power is cut off, this is a sign to the maintenance man to be careful and to try to check for the cause of the problem. This monitoring feature has special value when the winch is operating in the unwinding mode; it is not intended to affect operation of the system in the winding mode.

Another safeguard is provided by attaching to member 91 a wire 99 which is positive (low voltage, 12V) with respect to ground. The cable 100 is grounded through grounding of the winch reel 96, for example, via the reel holder 96*a*. A remote control box (not shown) is provided for the maintenance man with control wires longer than the radius of the ring carrier 24. This box controls relays that can open or close the 12V circuit connected to member 91. This box also controls the circuit supplying power to the drill, the latter circuit including a relay or equivalent which operates to open the power circuit when the microswitch 98 is depressed.

The pulley 92 is made of a dielectric material such as a plastic like nylon or PVC. When the lowering or raising system is working properly, the cable 100 should be riding in the groove of the pulley 92 which is insulated from the 12V applied to member 91. Should the cable somehow get out of that groove, however, and make contact with either leg of the member 91, or touch the traverse rod 91*a*, there will be a short circuit which will open an appropriate set of contacts of a relay in the circuit which supplies power to the drill so that the application of power to operate the winch is interrupted.

To further reduce the possibility of misfunctioning of the winch winding system, as shown in FIG. 8, there is provided a bead 106 fastened toward the periphery of the inner surfaces of the ends of the reel. This bead, which can have the cross-section shown or other cross-sections, helps to prevent the cable 100 from slipping off the end of the reel 96.

When it is desired to lower the ring carrier 24, the plug 72 is unplugged so that the electrical cable 71 may freely move up the center of the pole. If desired, the plug can temporarily be fastened to an appropriate point on the winch cable 100.

Bumper-Shock Absorber Subassembly 60 (FIGS. 1, 1A, 2 and 6)

While the subassembly 50 helps to provide individual adjustment of each of the cables 33, 35, 37 and 39 in the four line system shown in FIG. 1, it is assisted in this by the provision of the bumper-shock absorbers 60. There are four such subassemblies disposed in the carrier 24 at 90° separation around the central sxis of the pole in the carrier ring 24. Each bumper subassembly 60 comprises an outer tubular section 61 having an opening 61*a* toward its bottom. It also has an inner tubular member 62 whose lower ends are fixed, as by welding, to the bottom of the outer tube 61 and an intermediate tubular member 65 having an open lower end which is positioned between the inner and outer tubular members 61 and 62. Through the upper opening 68 in intermediate member 65 there protrudes a bumper 66 having a central axial passageway through which the outer ends of one of the cables 33, 35, 37 or 39 passes with a slight clearance around its periphery. The lower end of the member 66 has a flat edge 67 that helps to keep member 66 within the aperture 68 despite the upward pressure of the outer spring 63. Spring 63 extends down to the very bottom of the outer tube 61. The lower end of the cable 35 passes through opening 62*a* of the inner tube and is attached to a terminating device 69 having a somewhat conical shape. The lower end of device 69 extends somewhat outwardly and is generally urged downward by action of the spring 64 which extends substantially the entire length of the inner tube 62.

When the winch starts to wind up the cable 100 thereby raising ring carrier 24, there will come a time when the bumper 66 of one or more of the subassemblies 60 of the ring 24 will initially make contact with a hole 22*c* formed in the lower surface of the bottom of the top mast 22. Continued winding of the cable 35 will pull the terminator 69 up against the action of the spring 64 until terminator 69 reaches its maximum position within the inner tube 62. Then, since the inner tube 62 is attached to the outer tube 61, continued pulling of the line 35 will cause the outer tube 61 to rise against the pressure of the spring 63. It is thus seen that the subassembly 60 first absorbs the shock by the contact of the bumper 66 and then absorbs further upward movement of the cable 35 in the manner indicated.

Latching Subassembly 80—FIGS. 2, 4, 5

As stated above, in the embodiment of FIG. 1, a latching system is provided for suspending the ring carrier 24 from mast head 22 when the luminaire is in normal use at the top of the pole. The lower portion 82 of the latching mechanism comprises two vertical planar members 82*a* attached to the upper surface of the carrier housing in which two aligned apertures are formed. A generally cylindrical bushing or spacer 82*b* is positioned between the two apertures and a bolt 89 passes through the bore of the spacer and is held in place by nut 90. Around the spacer two springs 88 and 87 are independently and oppositely wound. One end of each spring is fixed in place whereas the other end is bent downward as shown in FIGS. 4 and 5 and is in contact with one side of the lower L-shaped member 84 tending to urge it to its neutral position. Member 84 is attached so as to pivot with the arm 85. A horizontally oriented stop 82*c* protrudes from a hole in one of the planar members 82*a* to limit the movement of the lower end of either spring if member 84 is deflected from its central position. The arm 85 passes upward through opening 82*d* in the top of the carrier and through opening 83*j* in the floor of the mast head. The members 83*e* and 83*d* are formed integrally with the housing 81 which can be made of a cast metal, for example. Housing 81 is fastened by means of bolts 83*b* passing through side extension portions 83*a* to the floor of the mast head 22.

Assuming that the ring 24 has been latched at the top of the pole, release is accomplished by the operator of the winch causing the ring to move upward closer to the bottom of the mast head than it does at its rest position. As it does so, the bumper-shock absorber assembly 60 will tend to resist movement of the carrier 24 somewhat, but then when it does, the bent-over portion 85*a* rides up against edge Y under the influence of spring 87 bearing against member 84. When it is higher than the tip 83*f*, that same pressure of spring 87 on member 84 will cause the portion 85*a* to move left past point 83*f* until it is free thereof and is in its central or neutral position. The operator does not know exactly when 85*a* clears 83*f* so that he will continue to wind up cable 100 on winch reel 96 until 85*a* touches the top of housing 81 whereupon the torque limiter 95 starts to slip or the motor of the powering drill stalls because of the insuperable resistance to further pull on the winch cable 100.

The operator then starts the downward movement of the carrier 24 by unwinding the winch cable 100 somewhat so that the portion 85*a* rides down against edge Z being cammed to the left against pressure exerted by spring 88 until the portion 85*a* is clear of the member 83*e* entirely thereby completely releasing the arm 85 from the portion 83 which returns to its normal central position. All four latch arms 85 will function similarly and when they do the carrier ring 24 can be lowered for maintenance or inspection purposes.

In order to re-latch the ring 24 onto the mast head 22, the opposite procedure occurs. Thus, the operator will pull down the winch cable 100 raising ring 24 until the portion 85*a* contacts edge W. Then as the ring continues to move upwardly, portion 85*a* will be cammed to the right against the pressure of spring 87. This will continue until portion 85*a* is free of tip 83*g* and when raised further touches edge U of stop member 83*d* and rides up to its maximum position. When the operator sees that the torque limiter is slipping he then starts to unwind the winch until portion 85*a* clears the point of stop 83*d* whereupon the action of the spring 87 will cause portion 85*a* to swing immediately to the left into contact with edge Y. Further lowering of the carrier ring 24 will then bring portion 85*a* to its starting position as shown in FIG. 4. When all four arms 85 are moved to the position shown in FIG. 4, the ring 24 has been fully latched.

Experience has taught that mutual lateral displacement of parts 81 and 82 abets the latching action because the portion 85*a* should make initial contact with edge W down close to the lower point of member 83*e*.

Alternate Embodiments—FIGS. 10 and 11

FIG. 10 shows another form of the invention having several differences from the form shown in FIG. 1. First, instead of the linkage subassembly 50, the subassembly 110 is used. Primed numbers are used for parts substantially identical to those previously explained. Subassembly 115 comprises two pulleys 112 and 114 which respectively supplant the members 51 and 52. Instead of having discrete lines 37 and 39 attached to both ends of member 51 and discrete lines 33 and 35 attached to both ends of member 52, the pulleys 110 in the mast head 22' are so arranged that the line 117 that goes over the right pair of pulleys 110 is looped under pulley 114 and then rises and over the pulley assembly 111 which is disposed 90° counterclockwise (as viewed in plan) from the right-hand set 110. After passing over pulleys 111, the other end of line 117 is attached to the bumper assembly 130 (not shown) associated with it. The same is true with the line 119 passing over the left set of pulleys 113 down under pulley 112 and then up to another pulley (not shown) and thence to its bumper assembly (not shown). The pulleys 112 and 114 are respectively coupled by links 116 and 118 to the opposite ends of the cross bar 120 which is substantially similar to the cross bar 53 of FIG. 9. The winch cable 122 is attached to the center of cross bar 120. It is thus seen that if there is stretching of the line going around the pulley 114, the difference is adjusted by the pulley 114 and the action of the bumper assembly connected to the other end of that line.

The second difference from the FIG. 1 form is that no shock absorbers such as shown in FIG. 1A or latches are used. Instead simple rubber or other resilient bumpers 133 engage the solid underside 22'*d* of the head 22. After contact of the bumpers is made and their slight compression thereafter, continued winding of lines 117 and 119 merely pulls up cable terminators 131 against the force of springs 132.

Since no latches are used when the carrier 24' is at the top of the pole, chains may be fastened from the cross bar 120, for example, to points inside the pole to support the carrier 24' thereby taking the brunt of the load off the winch cable 122.

FIG. 11 shows still another form of the invention wherein numbers that are doubly primed denote substantially the same items as shown in previous figures. There, instead of the cross-bar 120 as shown in FIG. 10, a third pulley 166 is used being connected to pulleys 161 and 163 by the line 165 attached to the bottoms of the pulley holders 162 and 164. The pulley holder 167 has attached to its bottom a swivelling ring 168 that is connected to the winch cable 169. It will be seen that differences in the elevation of pulleys 161 and 163 will raise or lower the pulley 166, as the case may be, thereby compensating for such differences.

Three Line Systems—FIGS. 12 and 13

Instead of the four-line system shown in FIGS. 1, 10 and 11, it is possible to have a three line system in which three sets of pulleys are disposed in the mast head at 120° spacing from one another around the central axis. In order to provide the "floating", self-compensating action of the subassemblies 50, 110 and 160, the ends of the lines 135, 137 and 139 as shown in FIG. 12 can be run through the three apertures in the three radial members 141*a* that are joined to a central hub 141. The respective lines are fastened by steel or lead bands 143 in a conventional manner. Attached below hub 141 is a tab 145 with an aperture to which the upper end of the winch line is fastened. The length of the portion 145 and the location of the aperture therein determines the flexibility or rigidity of the compensating action.

FIG. 13 shows another possible compensating linkage arrangement 150 for use with a three line system. It comprises a triangular, slightly dished member 152 having apertures 154 formed at each corner through which lines 151 extend. These lines are terminated by members 157 having a spherical end portion, the members 157 being applied by pressure or other conventional means to the ends of lines 151. The winch line 155 passes upward through the central aperture and is likewise terminated by one of the members 157. The spherical contour of the ends of members 157 when mating with the countersunk apertures 154 enable the position of plate 152 to vary without undue frictional wear.

I claim:

1. In a system for raising and lowering luminaires or the like to and from the top of a pole in which a luminaire carrier is suspended by cable means from a support means toward the top of said pole, the combination comprising:

(a) a plurality of upwardly-extending rod-like movable arms borne by said carrier and having their upper terminal portions angled relative to their lower portions, and (b) a corresponding plurality of means associated with said support means for engaging said arms respectively when said carrier has been raised to a position adjacent said top.

2. The combination according to claim 1 wherein said arms are normally biased to a central, substantially vertical position and wherein said means for engaging said arms includes a member having a notch into which said terminal portion travels.

3. The combination according to claim 2 wherein said member also includes a plurality of camming surfaces for guiding said terminal portion into said notch.

4. The combination according to claim 1 wherein said arm has its lower terminal portion mounted for pivotal movement about a substantially horizontal axis and wherein it is associated with resilient means urging it to its normal vertical position whenever it is pivoted away therefrom by the action of said camming surfaces.

5. The combination according to claim 1 wherein said means engaging said arms also includes stop means having a camming surface which engages said terminal portion when the latter is free of said member and higher than said notch.

6. In a system for raising and lowering by cable means a carrier for luminaires or the like to and from the top of a pole or the like where a support means is mounted, the combination comprising:

(a) a plurality of terminating means fixed to respective ends of said cables, (b) a corresponding first plurality of housing means associated with said carrier into which said cable ends extend, and (c) a corresponding, first plurality of resilient means disposed respectively within said housings and in contact with said terminating means and arranged to resist movement upward of said terminating means in said housings.

7. The combination according to claim 6 wherein said resilient means are disposed coaxially with said cable ends between said terminating means and said support means.

8. The combination according to claim 6 wherein said resilient means are compression springs.

9. The combination according to claim 6 wherein all of said housings are provided with apertures at their bottoms through which respective ones of said terminating means may pass.

10. The combination according to claim 6 wherein said housings are provided at their upper ends with impact-absorbing material to absorb the shock of the impact between the tops of said housings and said support means.

11. The combination according to claim 6 wherein the tops of said housings are provided with means projecting upwardly therefrom and wherein said support means is provided with a plurality of corresponding aperture means respectively engageable by said projections.

12. The combination according to claim 6 wherein a second plurality of resilient means are respectively disposed coaxially around corresponding ones of said first plurality of resilient means.

13. The combination according to claim 12 wherein said second plurality of resilient means are compression springs and are disposed exterior to said housings.

14. The combination according to claim 12 wherein a second plurality of housing members are also associated with said carrier, each of which is coaxially arranged with one of said first plurality of housing members and at least partially around one of said second plurality of springs.

* * * * *